US009857142B2

(12) United States Patent
Sharron et al.

(10) Patent No.: US 9,857,142 B2
(45) Date of Patent: Jan. 2, 2018

(54) SWIVEL QUICK RELEASE

(71) Applicants: Matthew A. Sharron, Seymour, CT (US); Andrew Visinski, Seymour, CT (US)

(72) Inventors: Matthew A. Sharron, Seymour, CT (US); Andrew Visinski, Seymour, CT (US)

( * ) Notice: Subject to any disclaimer, the term of this patent is extended or adjusted under 35 U.S.C. 154(b) by 192 days.

(21) Appl. No.: 14/864,988

(22) Filed: Sep. 25, 2015

(65) Prior Publication Data

US 2016/0202019 A1 Jul. 14, 2016

Related U.S. Application Data

(60) Provisional application No. 62/058,225, filed on Oct. 1, 2014.

(51) Int. Cl.
*F41C 27/00* (2006.01)
*F41G 11/00* (2006.01)

(52) U.S. Cl.
CPC ..... *F41C 27/00* (2013.01); *F41G 11/003* (2013.01); *F41G 11/006* (2013.01)

(58) Field of Classification Search
CPC ..... F41G 1/387; F41G 11/00; F41G 11/003; F41G 11/006; F41C 27/00
See application file for complete search history.

(56) References Cited

U.S. PATENT DOCUMENTS

2008/0034638 A1* 2/2008 Spuhr ..... F41G 11/006 42/127
2010/0005697 A1* 1/2010 Fluhr ..... F41G 1/02 42/111
2015/0159977 A1* 6/2015 Tseng ..... F41C 23/12 42/75.03
2016/0003460 A1* 1/2016 Li ..... F21V 21/08 362/191
2016/0097611 A1* 4/2016 Sharron ..... F41C 27/00 42/90
2017/0045334 A1* 2/2017 Yim ..... F41G 11/003
2017/0067720 A1* 3/2017 Visinski ..... F41C 27/00

FOREIGN PATENT DOCUMENTS

WO WO 2013177036 A1 * 11/2013 ..... F41G 11/003

* cited by examiner

*Primary Examiner* — Gabriel Klein
(74) *Attorney, Agent, or Firm* — Buckingham, Doolittle & Burroughs, LLC

(57) ABSTRACT

An improved device for enabling a user to quickly and securely attach and detach an accessory (e.g., a scope, light, bayonet, etc.) to the Picatinny or tactical rail of a firearm. In a preferred embodiment of the present invention, the device comprises a lower portion, an upper portion and a locking mechanism. The device is relatively inexpensive to manufacture and safe and easy to use.

16 Claims, 6 Drawing Sheets

SWIVEL QUICK RELEASE

CROSS-REFERENCE

This application claims priority from Provisional Patent Application Ser. No. 62/058,225 filed Oct. 1, 2014.

FIELD OF THE INVENTION

This invention relates to a quick release attachment for mounting accessories (e.g., a scope, light, bayonet, etc.) on the Picatinny or tactical rail of a firearm.

BACKGROUND

Many individuals and firearm enthusiasts desire to mount one or more interchangeable accessories, such as a scope, light, bayonet and the like, onto their firearms. Historically, this has been accomplished by fixedly mounting the accessory to the Picatinny or tactical rail of the firearm, which is essentially a bracket that can be attached to a firearm and which provides a standard mounting platform for a desired attachment. However, heretofore, the process of mounting such accessories to the Picatinny rail has required the use of external tools, and has been both awkward and time-consuming. Moreover, the inability to timely attach a desired accessory to a firearm, or switch accessories, can be dangerous for the user. For example, in combat, a soldier's inability to quickly attach a bayonet to his or her firearm could result in death or serious injury to the soldier.

Consequently, there is a long felt need in the art for a device that enables a user to quickly and securely attach/detach an accessory (e.g., a scope, light, bayonet, etc.) to the Picatinny or tactical rail of a firearm without the use of external tools. There is also a long felt need for a device that is capable of being locked/unlocked with a single hand, thereby allowing the user to retain possession of the firearm with his or her remaining hand. Finally, there is a long felt need for a device that accomplishes all of the forgoing objectives, and that is relatively inexpensive to manufacture and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed herein, in one aspect thereof, is a device for enabling a user to quickly and securely attach/detach an accessory (e.g., a scope, light, bayonet, etc.) to the Picatinny or tactical rail of a firearm. In a preferred embodiment of the present invention, the device comprises a lower portion; an upper portion; and a locking mechanism, wherein said locking mechanism further comprises an elongated arm portion, a handle portion, a rotating lock with a locking key and a spring.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
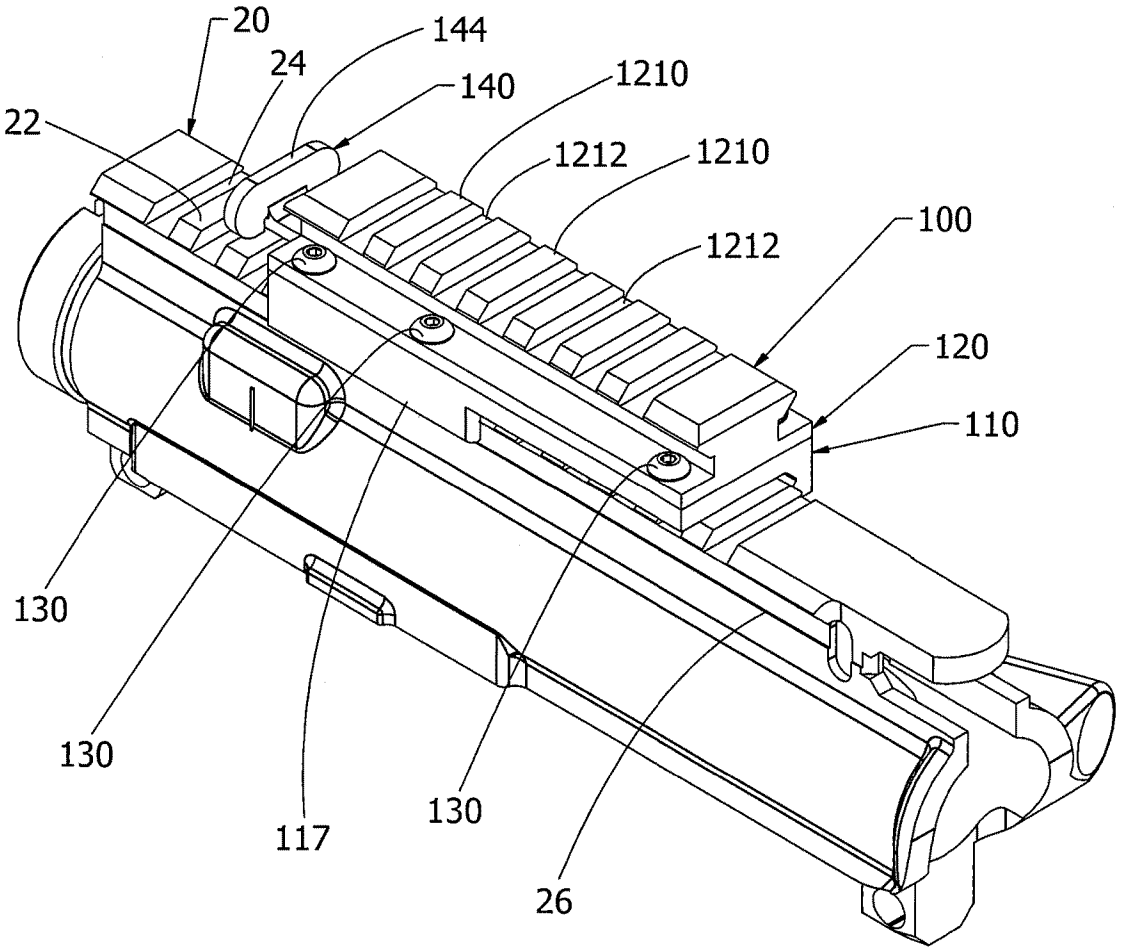
FIG. 1 is a perspective view of a preferred embodiment of the device of the present invention securely attached to a Picatinny rail of a firearm.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

Figure 2:
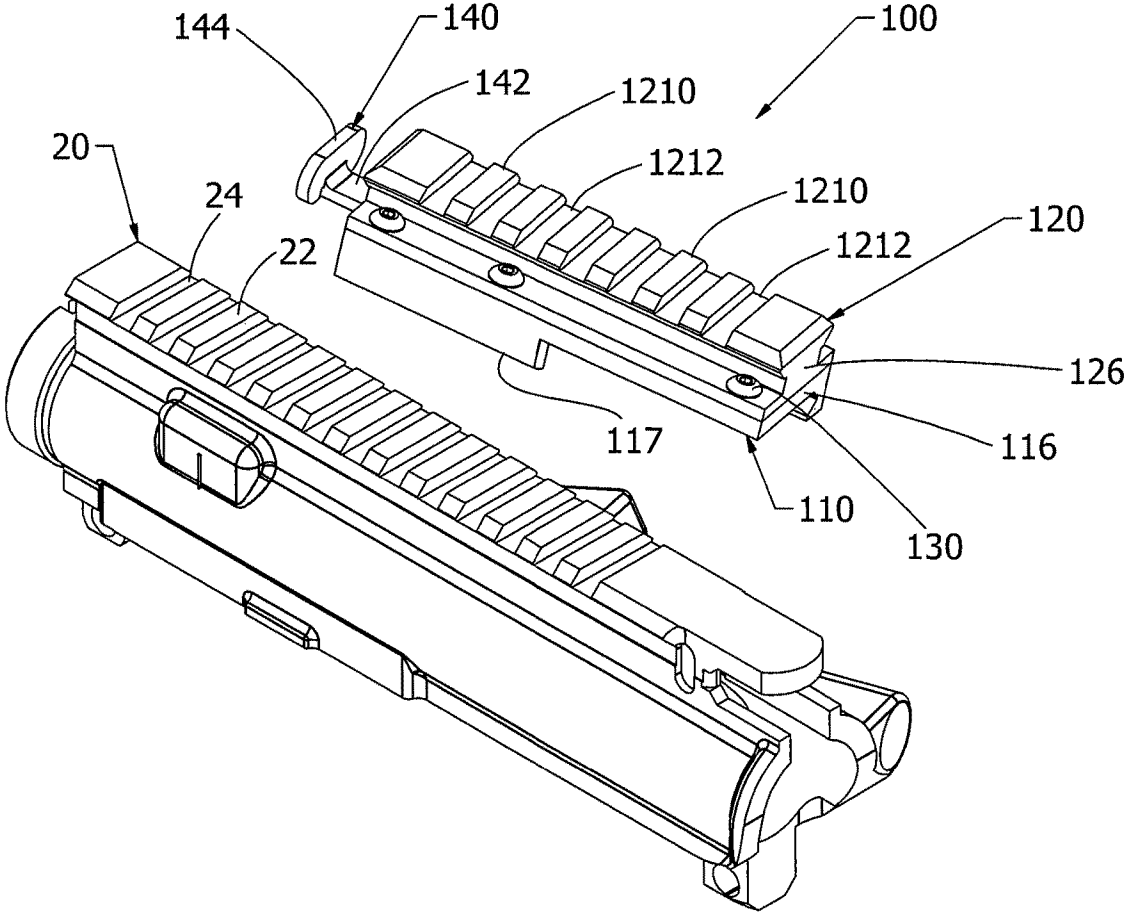
FIG. 2 is a perspective view of the device of FIG. 1 detached and apart from a Picatinny rail of a firearm.

Referring initially to the drawings, FIG. 1 depicts a perspective view of a preferred embodiment of the swivel quick release device 100 of the present invention securely attached to a Picatinny rail 20 of a firearm, and FIG. 2 depicts a perspective view of the swivel quick release device 100 of the present invention detached from Picatinny rail 20. By way of background, Picatinny rail 20 is an elongated bracket that may be attached to a firearm to provide a standard mounting platform for accessories and attachments such as a scope, light, bayonet and the like. Rail 20 is typically comprised of a plurality of raised spaced apart lugs or ridges 22 along its top or upper surface, with channels 24 located between and formed by said ridges 22, and a rail flange 26 extending along each side of rail 20.

Figure 3:
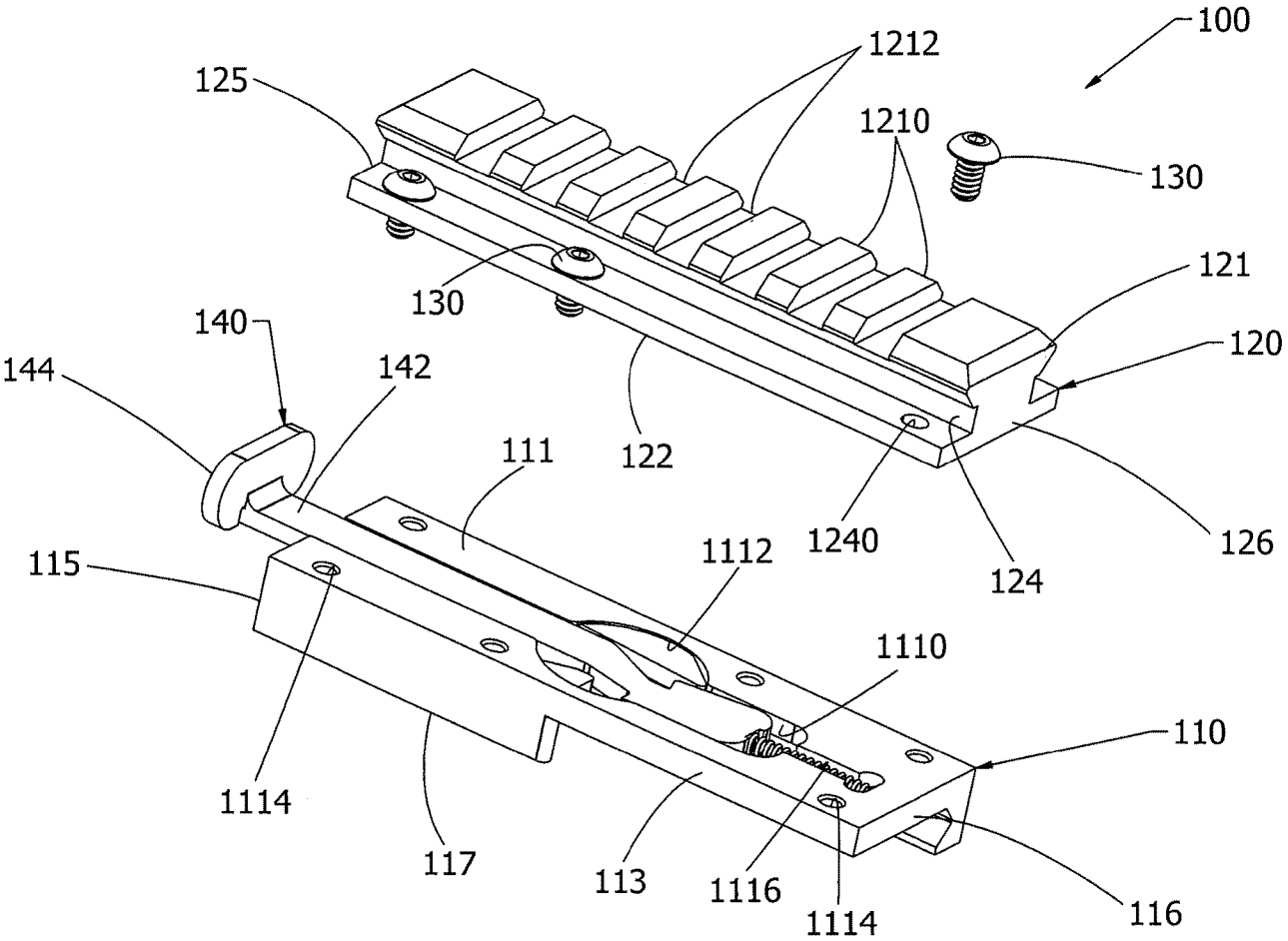
FIG. 3 is a perspective and partially exploded view of the device of FIG. 1.
Figure 4:
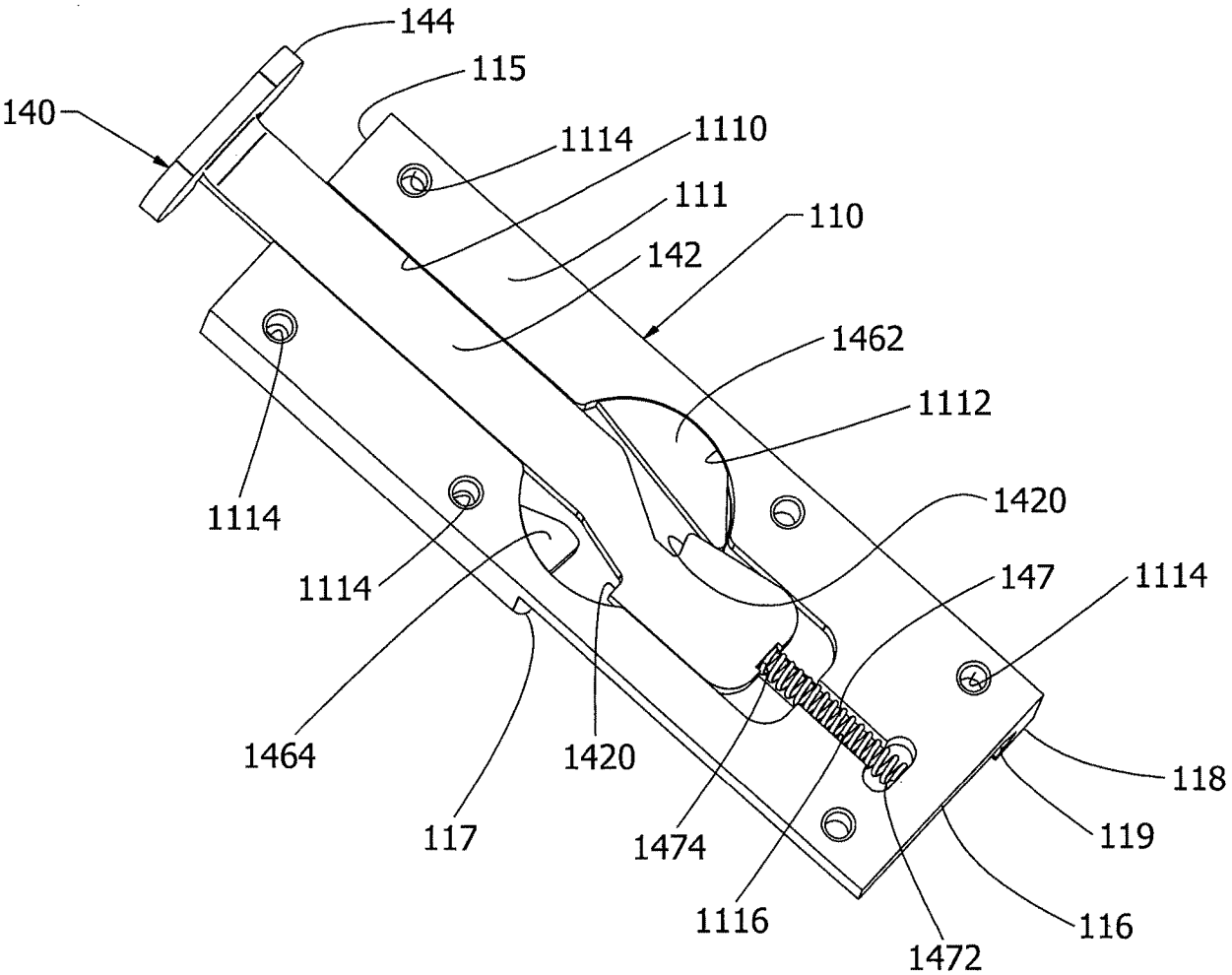
FIG. 4 is a top perspective view of the lower portion of the device of FIG. 1.
Figure 5:
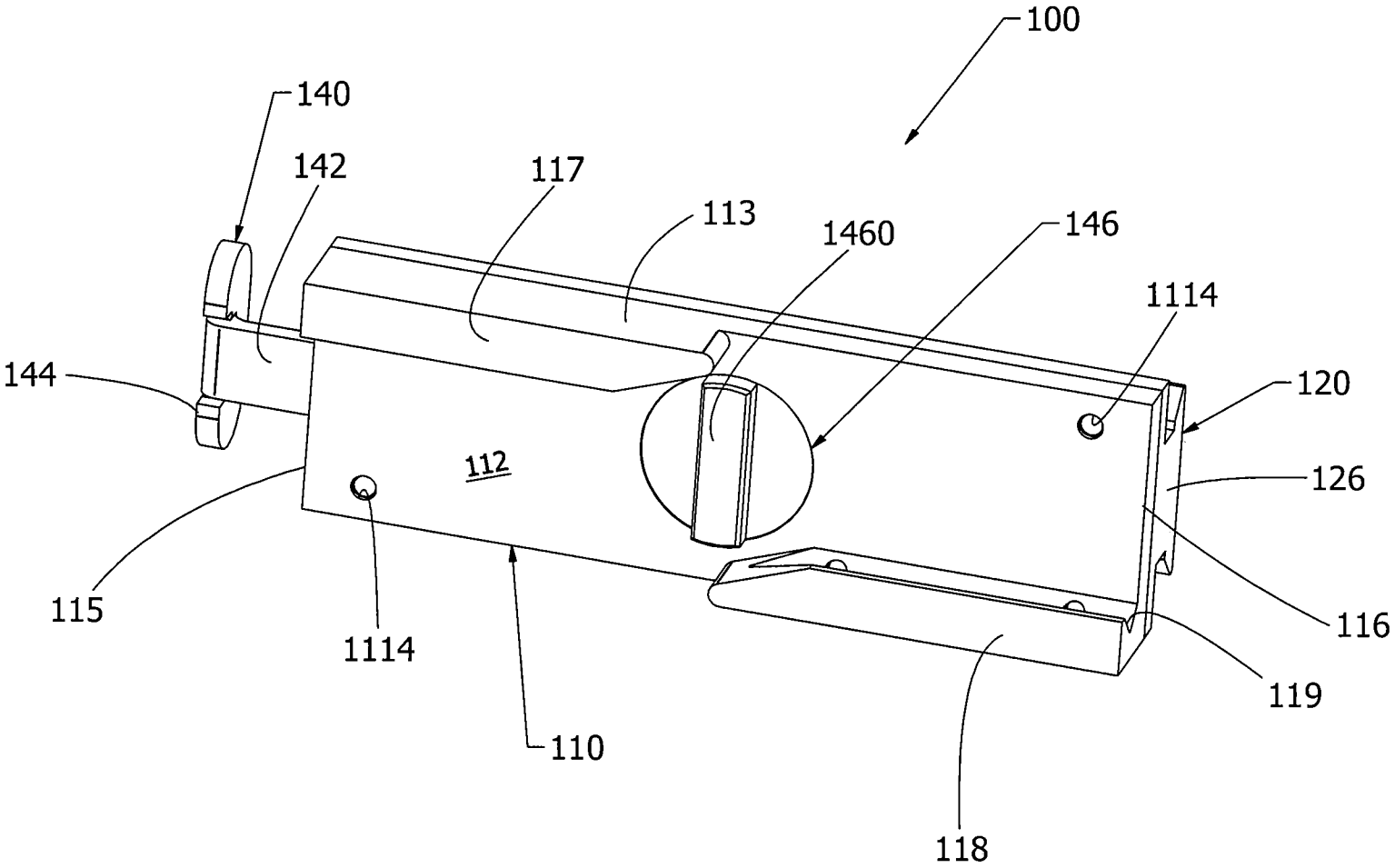
FIG. 5 is a bottom perspective view of the device of FIG. 1.

The swivel quick release device 100 of the present invention is preferably comprised of a lower portion 110, an upper portion 120 removably attached to said lower portion 110 through the use of fasteners 130 and a locking mechanism 140 for detachably securing device 100 to rail 20 without the need for external tools. As best illustrated in FIGS. 3-5, lower portion 110 is an elongated member having a top surface 111, a bottom surface 112, opposing side surfaces 113, a rear 115, a front 116, a rear fence 117 and a forward fence 118, wherein said rear fence 117 and said forward fence 118 extend downwardly from said bottom surface 112 for mating engagement with rail 20, as described more fully below.

Said top surface 111 further comprises an elongated longitudinal opening or channel 1110 therein for receipt of a portion of locking mechanism 140, as described more fully below. Channel 1110 extends along a partial length of lower portion 110 from rear 115 in the direction of front 116. Top surface 111 further comprises a spring channel 1116 for receipt of a spring 147, wherein said spring channel 1116 also extends a partial length of lower portion 110 from channel 1110 in the direction of front 116.

Lower portion 110 further comprises a continuous opening 1112 that extends between top surface 111 and bottom surface 112 for receipt of a portion of locking mechanism 140, as described more fully below. Top surface 111 of lower portion 110 may also comprise a plurality of spaced apart openings 1114 for receipt of fasteners 130 to fixedly attach lower portion 110 to upper portion 120.

As previously described, lower portion 110 is also comprised of a pair of spaced apart fences 117, 118 that extend downwardly from said bottom surface 112 for mating engagement with rail 20. More specifically, rear fence 117 protrudes downwardly from one side of bottom surface 112 towards the front 116 of lower portion 110 and has a length that extends parallel to the length of lower portion 110, but only partially along said length. Similarly, forward fence 118 protrudes downwardly from the opposite side of bottom surface 112 towards the rear 115 of lower portion 110 and has a length that extends parallel to the length of lower portion 110, but only partially along said length as best shown in FIG. 5. Each of rear fence 117 and forward fence 118 further comprise a generally v-shaped groove 119 extending along a substantial portion of the length of each of said rear and forward fences 117, 118 for mating engagement with rail flanges 26 of rail 20.

Upper portion 120 is also a generally elongated member that is comprised of a top 121, an opposing bottom 122, a pair of opposing side slots 124, a rear end 125 and a front end 126. Similar to Picatinny rail 20, top 121 is also comprised of a plurality of raised spaced apart lugs or ridges 1210, with channels 1212 located between said ridges 1210 and formed by said ridges 1210. Bottom 122 is generally flat and preferably corresponds in shape and size with top surface 111 of lower portion 110 as shown in the Figures. Opposing side slots 124 are similar to rail flanges 26 in rail 20, and preferably extend between rear end 125 and front end 126 and are useful for attaching accessories (such as a scope, light, bayonet, etc.) to device 100 in generally the same manner that accessories (not shown) would ordinarily be attached to rail 20. Opposing side slots 124 may further comprise a plurality of spaced apart openings 1240 extending entirely through bottom 122. The number and placement of openings 1240 preferably correspond to the number and placement of openings 1114 in lower portion 110 for receipt of fasteners 130, which are used to fixedly attach upper portion 120 to lower portion 110 as best shown in FIGS. 1-3.

Figures 6A, 6B:
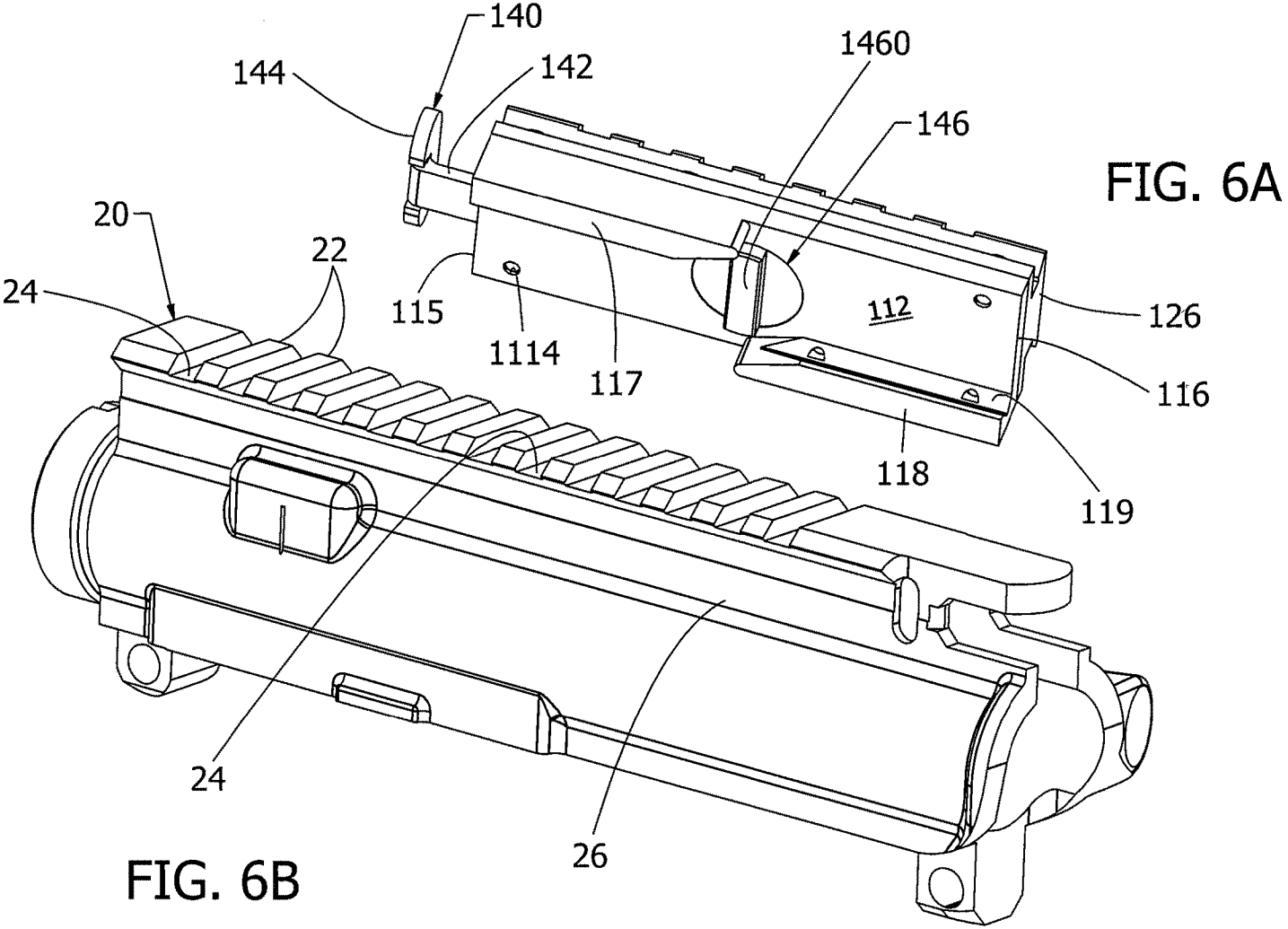
FIG. 6A is a bottom perspective view of the device of FIG. 1.
FIG. 6B is a perspective view of a Picatinny rail of a firearm.

As best shown in FIGS. 4, 5 and 6A, locking mechanism or linear lock release 140 is preferably comprised of an elongated arm portion 142, a handle portion 144 for engaging and dis-engaging locking mechanism 140, a rotating lock 146 and a spring 147. In a preferred embodiment of the present invention, handle portion 144 is integrally formed with arm portion 142, and arm portion 142 is sized to fit and slide longitudinally within channel 1110 between a locked position and an unlocked position, as described more fully below. Arm portion 142 also further comprises at least one notch 1420 on each of its sides for receipt of a latch on one side and a safety stop on the opposing side, as described more fully below.

More specifically, rotating lock 146 further comprises a locking key 1460 positioned along the bottom surface of rotating lock 146 for mating engagement with a selected channel 24 along rail 20, and a latch 1462 and a safety stop 1464 positioned on a top surface of rotating lock 146 for mating engagement with a respective one of notches 1420 in arm portion 142. In a preferred embodiment of the present invention, each of latch 1462, safety stop 1464 and locking key 1460 are integrally formed with rotating lock 146. More specifically, each of latch 1462 and safety stop 1464 extends upwardly from the top surface of rotating lock 146 for mating engagement with a respective one of notches 1420 in arm portion 142, thereby preventing longitudinal or rotational movement of device 100 relative to rail 20 when locking mechanism 140 is in the locked position, as described more fully below. Similarly, locking key 1460 extends downwardly from rotating lock 146 beyond the bottom surface 112 of lower portion 110 for mating engagement with one of channels 24 (between two of ridges 22) in rail 20, thereby preventing longitudinal movement of device 100 relative to rail 20 when locking mechanism 140 is in the locked position, as described more fully below.

Spring 147 is positioned within spring channel 1116 in lower member 110 and is comprised of a first end 1472 and a second end 1474. Spring 147 is biased in the general direction of arm member 142, as best shown in FIG. 4, and first end 1472 is fixedly attached to lower portion 110 and second end is fixedly attached to the end of arm portion 142 opposite of handle portion 144.

Having now described the general structure of a preferred embodiment of device 100, its function will now be described in general terms. A user (not shown) desiring to securely mount device 100 onto rail 20 would simply place device 100 (in an unlocked position) at a desired position along and on top of Picatinny rail 20 at a slight angle—meaning that the alignment of device 100 would be slightly offset (i.e., preferably less than 45°) from rail 20 but so that fences 117, 118 clear rail flanges 26 and locking key 1460 is capable of being inserted into a select one of said channels 24 (between two of ridges 22). FIG. 6B is a perspective view of a Picatinny rail 20 of a firearm. Once device 100 is placed on rail 20 such that locking key 1460 is placed within a selected one of channels 24 along rail 20 (between two of ridges 22), the user would rotate device 100 to generally align the same longitudinally with rail 20. As device 100 is being rotated, locking key 1460 will cause latch 1462 to disengage from notch 1420 and spring 147 will elongate, thereby causing arm portion 142 to slide outwardly along channel 1110. Nonetheless, safety stop 1464 will prevent arm portion 142 from being removed from channel 1110, as shown in FIG. 4. As device 100 is rotated into a position substantially parallel with rail 20, rear fence 117 matingly engages with one of rail flanges 26 and front fence 118 matingly engages with the opposite rail flange 26, while locking key 1460, which is positioned within a select channel 24 between two of ridges 22, prevents longitudinal movement of device 100 relative to rail 20 while locking mechanism 140 is in the locked position.

Similarly, to unlock locking mechanism 140 to reposition device 100 along rail 20 or remove device 100 from rail 20 altogether, a user (not shown) would simply push handle portion 144 in the direction of device 100, thereby compressing spring 147 and engaging latch 1462 with notch 1420, and rotating device 100 relative to rail 20 to disengage rear fence 117 and front fence 118 from their respective rail flange 26.

Other variations are also within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A device for enabling a user to detachably mount an accessory on a Picatinny rail of a firearm device comprising:

a lower portion;

an upper portion; and a locking mechanism, wherein said locking mechanism further comprises an elongated arm portion, a handle portion, a rotating lock and a spring, wherein said spring has a first end and a second end, and further wherein said first end is attached to said elongated arm portion and said second end is attached to said lower portion.

2. The device of claim 1, wherein said rotating lock further comprises a latch and a safety stop and further wherein said elongated arm portion further comprises at least one notch.

3. The device of claim 1, wherein said lower portion further comprises a top surface, a bottom surface, an opening extending from said top surface to said bottom surface and a channel for receipt of a portion of said locking mechanism.

4. The device of claim 3, wherein said lower portion further comprises at least one fence with a groove therein.

5. The device of claim 1, wherein said lower portion further comprises a spring channel with a spring located at least partially therein.

6. The device of claim 1, wherein said upper portion further comprises a top, a bottom and at least one side slot.

7. The device of claim 6, wherein said top further comprises a plurality of alternating ridges and channels.

8. A device for attachment to a Picatinny rail comprising:

an upper portion comprised of plurality of alternating ridges and channels;

a lower portion removably attached to said upper portion; and a locking mechanism, wherein said locking mechanism is at least partially encompassed by said upper portion and said lower portion and further comprises an elongated arm portion, a handle portion, a rotating lock and a spring, and further wherein said spring has a first end that is attached to said elongated arm portion and a second end that is attached to said lower portion.

9. The device of claim 8, wherein said rotating lock further comprises a latch and a safety stop and further wherein said elongated arm portion further comprises at least one notch.

10. The device of claim 8, wherein said lower portion further comprises a top surface, a bottom surface, an opening extending from said top surface to said bottom surface and a channel for receipt of a portion of said locking mechanism.

11. The device of claim 8, wherein said lower portion further comprises at least one fence with a groove therein.

12. The device of claim 8, wherein said lower portion further comprises a spring channel with a spring located at least partially therein.

13. The device of claim 8, wherein said upper portion further comprises a top, a bottom and at least one side slot.

14. A device for attachment to a Picatinny rail comprising:

an upper portion comprised of plurality of alternating ridges and channels;

a lower portion removably attached to said upper portion and comprising a top surface, a bottom surface, an opening extending from said top surface to said bottom surface, a channel, and a spring channel with a spring located at least partially therein; and a locking mechanism comprising an elongated arm portion with at least one notch therein, a handle portion, a rotating lock, a latch and a safety stop, wherein a first end of said spring is attached to said elongated arm portion and a second end of said spring is attached to said lower portion.

15. The device of claim 14, wherein said locking mechanism is repositionable from an unlocked position to a locked position by pulling said handle portion in a direction generally opposite of the device.

16. The device of claim 14, wherein said locking mechanism is repositionable from a locked position to an unlocked position by pushing said handle portion towards said device.

* * * * *